US007793629B2

(12) United States Patent
Ikihara et al.

(10) Patent No.: US 7,793,629 B2
(45) Date of Patent: Sep. 14, 2010

(54) VALVE TIMING CONTROL SYSTEM

(75) Inventors: Tadao Ikihara, Okazaki (JP); Tatsuhiko Imaizumi, Kariya (JP)

(73) Assignee: Denso Corporation, Kariya (JP)

( * ) Notice: Subject to any disclaimer, the term of this patent is extended or adjusted under 35 U.S.C. 154(b) by 388 days.

(21) Appl. No.: 12/050,773

(22) Filed: Mar. 18, 2008

(65) Prior Publication Data

US 2008/0230025 A1 Sep. 25, 2008

(30) Foreign Application Priority Data

Mar. 19, 2007 (JP) ..... 2007-070064

(51) Int. Cl.
*F01L 1/34* (2006.01)

(52) U.S. Cl. ..... 123/90.17; 123/90.15

(58) Field of Classification Search ..... 123/90.15, 123/90.17

See application file for complete search history.

(56) References Cited

U.S. PATENT DOCUMENTS

| | | | | |
|---|---|---|---|---|
| 6,505,586 | B1 | 1/2003 | Sato et al. | |
| 6,634,329 | B2 * | 10/2003 | Kusano et al. | 123/90.17 |
| 6,739,298 | B2 * | 5/2004 | Kusano et al. | 123/90.17 |
| 6,779,499 | B2 * | 8/2004 | Takenaka et al. | 123/90.17 |
| 7,225,775 | B2 * | 6/2007 | Ogawa | 123/90.17 |
| 2002/0100445 | A1 * | 8/2002 | Takenaka et al. | 123/90.17 |
| 2002/0139333 | A1 * | 10/2002 | Kusano et al. | 123/90.17 |
| 2003/0217716 | A1 * | 11/2003 | Kusano et al. | 123/90.17 |
| 2007/0251475 | A1 * | 11/2007 | Suga et al. | 123/90.17 |
| 2008/0230025 | A1 * | 9/2008 | Ikihara et al. | 123/90.17 |

FOREIGN PATENT DOCUMENTS

| | | |
|---|---|---|
| JP | 2998565 | 11/1999 |
| JP | 2008-038669 | 2/2008 |

OTHER PUBLICATIONS

Japanese Office Action dated Feb. 25, 2009, issued in corresponding Japanese Application No. 2007-070064, with English translation.

* cited by examiner

*Primary Examiner*—Thomas E Denion
*Assistant Examiner*—Daniel A Bernstein
(74) *Attorney, Agent, or Firm*—Nixon & Vanderhye PC

(57) ABSTRACT

A valve enables and disables communication of a bypass passage, which extends from a fluid supply passage and bypasses at least one fluid control valve, to at least one of a retarding passage and an advancing passage connected to a valve timing mechanism. An ECU controls the valve to enable the communication of the bypass passage to the at least one of the retarding passage and the advancing passage when a temperature is equal to or less than a predetermined temperature. The ECU controls the valve to disable the communication of the bypass passage to the at least one of the retarding passage and the advancing passage when the temperature is higher than the predetermined temperature.

15 Claims, 11 Drawing Sheets

VALVE TIMING CONTROL SYSTEM

CROSS REFERENCE TO RELATED APPLICATION

This application is based on and incorporates herein by reference Japanese Patent Application No. 2007-70064 filed on Mar. 19, 2007.

BACKGROUND OF THE INVENTION

1. Field of the Invention

The present invention relates to a valve timing control system, which controls opening and closing timing (hereinafter, simply referred to as valve timing) of at least one of an intake valve and an exhaust valve of an internal combustion engine.

2. Description of Related Art

In a previously proposed valve timing control system, a rotational phase of a driven shaft relative to a driving shaft is controlled by a fluid pressure of working fluid, which is supplied to retarding chambers and advancing chambers, to control valve timing of at least one of an intake valve and an exhaust valve (see, for example, Japanese Patent No. 2998565). The supplying of the working fluid to the retarding chambers and the advancing chambers and draining of the working fluid from the retarding chambers and the advancing chambers are controlled by a fluid control valve, which is formed as, for example, a known solenoid spool valve.

However, an opening area of the fluid control valve is smaller than a fluid passage of other devices other than the fluid control valve. Thus, when a viscosity of the working fluid, such as hydraulic oil, is increased under the low temperature condition, a flow quantity of the working fluid, which is supplied from the fluid control valve to the retarding chambers and the advancing chambers, is reduced in comparison to the high temperature condition. Thus, the time, which is required to fill the hydraulic oil into the retarding chambers or the advancing chambers to execute the phase control, is disadvantageously increased, so that the response in the phase control is reduced, i.e., impaired. When the response in the phase control is reduced, the timing for controlling the valve timing is deviated.

SUMMARY OF THE INVENTION

The present invention is made in view of the above disadvantages. Thus, it is an objective of the present invention to provide a valve timing control system, which can improve response in phase control under a low temperature condition.

To achieve the objective of the present invention, there is provided a valve timing control system provided in a drive force transmission system, which transmits a drive force from a driving shaft of an internal combustion engine to a driven shaft that is driven to open and close at least one of an intake valve and an exhaust valve of the engine. The valve timing control system controls opening and closing timing of at least one of the intake valve and the exhaust valve. The valve timing control system includes a valve timing mechanism, at least one fluid control valve, a communication control valve and a bypass control means. The valve timing mechanism controls a rotational phase of the driven shaft relative to the driving shaft according to a fluid pressure of working fluid exerted in at least one retarding chamber of the valve timing mechanism and a fluid pressure of working fluid exerted in at least one advancing chamber of the valve timing mechanism. The at least one fluid control valve is connected to a fluid supply passage and a fluid drain passage at a first side of the at least one fluid control valve and is connected to a retarding passage communicated with the at least one retarding chamber and an advancing passage communicated with the at least one advancing chamber at a second side of the at least one fluid control valve. The at least one fluid control valve controls a communication state of the retarding passage and the advancing passage relative to the fluid supply passage and the fluid drain passage. The communication control valve enables and disables communication of a bypass passage, which extends from the fluid supply passage and bypasses the at least one fluid control valve, to at least one of the retarding passage and the advancing passage. The bypass control means is for controlling the communication control valve. The bypass control means controls the communication control valve to enable the communication of the bypass passage to the at least one of the retarding passage and the advancing passage when a temperature is equal to or less than a predetermined temperature. The bypass control means controls the communication control valve to disable the communication of the bypass passage to the at least one of the retarding passage and the advancing passage when the temperature is higher than the predetermined temperature.

To achieve the objective of the present invention, there is also provided a valve timing control system provided in a drive force transmission system, which transmits a drive force from a driving shaft of an internal combustion engine to a driven shaft that is driven to open and close at least one of an intake valve and an exhaust valve of the engine. The valve timing control system controls opening and closing timing of at least one of the intake valve and the exhaust valve. The valve timing control system includes a valve timing mechanism, a first fluid control valve and a second fluid control valve. The valve timing mechanism controls a rotational phase of the driven shaft relative to the driving shaft according to a fluid pressure of working fluid exerted in at least one retarding chamber of the valve timing mechanism and a fluid pressure of working fluid exerted in at least one advancing chamber of the valve timing mechanism. The first fluid control valve is connected to a fluid supply passage and a fluid drain passage at a first side of the first fluid control valve and is connected to a retarding passage communicated with the at least one retarding chamber and an advancing passage communicated with the at least one advancing chamber at a second side of the first fluid control valve. The first fluid control valve includes a first housing, a first valve member and a first solenoid driving arrangement. The first housing includes a plurality of openings, which are communicated with the fluid supply passage, the fluid drain passage, the retarding passage and the advancing passage, respectively. The first valve member is reciprocably received in the first housing to control a communication state of the retarding passage and the advancing passage relative to the fluid supply passage and the fluid drain passage according to a position of the first valve member in a reciprocating direction of the first valve member. The first solenoid driving arrangement drives the first valve member in the reciprocating direction of the first valve member. The second fluid control valve is connected to the fluid supply passage and the fluid drain passage at a first side of the second fluid control valve and is connected to the retarding passage and the advancing passage at a second side of the second fluid control valve. The second fluid control valve is placed in parallel with the first fluid control valve. The second fluid control valve includes a second housing, a second valve member and a second solenoid driving arrangement. The second housing includes a plurality of openings, which are communicated with the fluid supply passage, the fluid drain passage, the retarding passage and the advancing passage, respectively. The second valve member is reciprocably received in the second housing to control the communication state of the retarding passage and the advancing passage relative to the fluid supply passage and the fluid drain passage according to a position of the second valve member in a reciprocating direction of the second valve member. The second solenoid driving arrangement drives the second valve member in the reciprocating direction of the second valve member. A seal length between the second valve member and an inner peripheral wall of the second housing in the second fluid control valve is shorter than a seal length between the first valve member and an inner peripheral wall of the first housing in the first fluid control valve.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF THE INVENTION

First Embodiment

Figure 1:
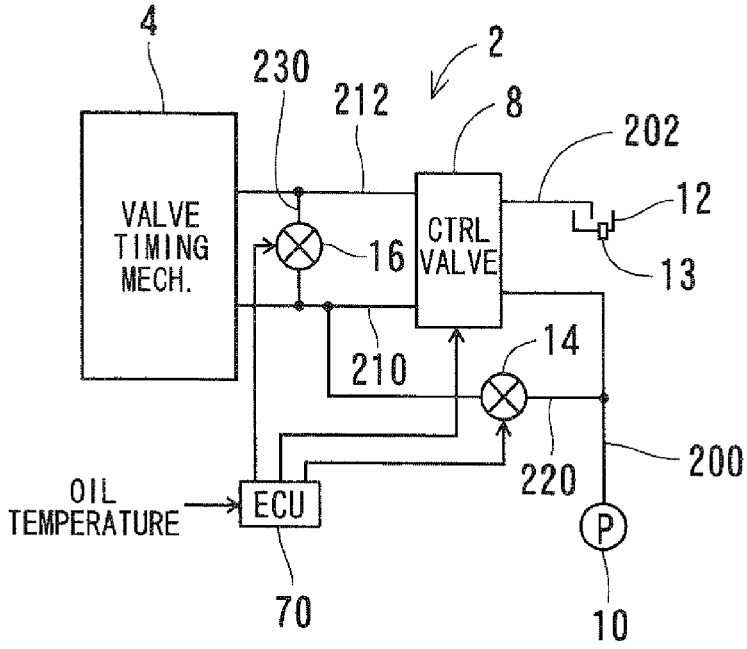
FIG. 1 is a schematic view of a valve timing control system according to a first embodiment of the present invention.

FIG. 1 shows a valve timing control system according to a first embodiment of the present invention. The valve timing control system 2 of the present embodiment is of a hydraulically controlled type that uses a hydraulic pressure of hydraulic oil as a fluid pressure of working fluid and controls valve timing of intake valves. A valve timing mechanism 4 of the valve timing control system 2 transmits a drive force of an undepicted crankshaft (serving as a driving shaft) to a camshaft (serving as a driven shaft) 6.

An oil supply passage 200 and an oil drain passage 202 are connected to a retarding oil passage 210 and an advancing oil passage 212 through an oil control valve (serving as a fluid control valve) 8. The oil supply passage 200 serves as a fluid supply passage of the present invention, and the oil drain passage 202 serves as a fluid drain passage of the present invention. The oil control valve 8 is a solenoid valve of a known type, which uses an axially slidable spool as a valve member. The oil control valve 8 communicates between a selected one of the oil supply passage 200 and the oil drain passage 202 and a selected one of the retarding oil passage 210 and the advancing oil passage 212 depending on a position of a spool, which is reciprocally driven by a drive force of a solenoid driving arrangement. The oil control valve 8 can be also placed in an intermediate holding position, at which the oil supply passage 200 and the oil drain passage 202 are both discommunicated from the retarding oil passage 210 and the advancing oil passage 212.

A bypass oil passage (serving as a bypass passage) 220 connects between the oil supply passage 200 and the retarding oil passage 210 while bypassing the oil control valve 8. A solenoid valve (serving as a bypass opening and closing valve that is also referred to as a communication control valve) 14 is provided in the bypass oil passage 220 to open and close the bypass oil passage 220. A connection oil passage (serving as a connection passage) 230 connects between the retarding oil passage 210 and the advancing oil passage 212. A solenoid valve (serving as a connection opening and closing valve) 16 is provided in the connection oil passage 230 to open and close the connection oil passage 230.

An electronic control unit (ECU) 70, which serves as a bypass control means, includes a CPU, a ROM, a RAM and a flush memory. The ECU 70 executes a control program, which is stored in the ROM or the flush memory, to switch the oil control valve 8 based on an operational state of an internal combustion engine and also opens and closes the solenoid valves 14, 16 based on a measurement signal of an oil temperature sensor 13 provided in a drain 12.

A structure of the valve timing mechanism 4 will be described with FIGS. 2 and 3.

A housing (serving as a driving-side rotator) 20 includes a chain sprocket (forming one of two side walls of the housing) 22, a peripheral wall 25 and a front plate (forming the other one of the two side walls) 26. The peripheral wall 25 and the front plate 26 are formed integrally and form a shoe housing 24. The chain sprocket 22 and the shoe housing 24 are coaxially fixed together by bolts 32. The chain sprocket 22 is coupled with the undepicted crankshaft through an undepicted chain to receive a drive force therefrom and is thereby rotated together with the crankshaft.

The camshaft (serving as the driven shaft) 6 receives the drive force of the crankshaft through the valve timing mechanism 4 to open and close the undepicted intake valves. The camshaft 6 is rotatable relative to the chain sprocket 22 while maintaining a predetermined phase difference therebetween. The housing 20 and the camshaft 6 rotate in a clockwise direction when the housing 20 and the camshaft 6 are viewed in a direction of an arrow X in FIG. 2. Hereinafter, this rotational direction will be referred to as an advancing direction.

Figure 3:
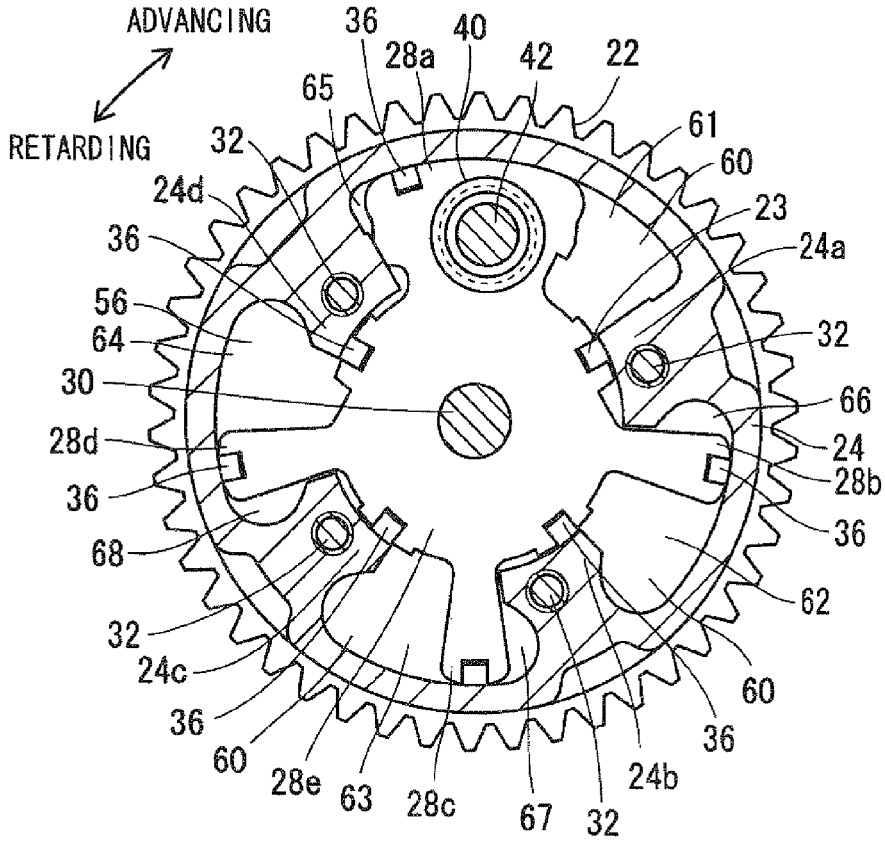
FIG. 3 is a transverse cross sectional view showing the valve timing mechanism of the first embodiment.

As shown in FIG. 3, the shoe housing 24 includes four shoes 24*a*-24*d*, which are formed as trapezoidal partitions arranged one after another in the rotational direction. An inner peripheral surface of each shoe 24*a*-24*d* is configured to form an arcuate cross section. The shoes 24*a*-24*d* define four fan-shaped gaps in the rotational direction. These gaps form receiving chambers 60, which receive vanes 28*a*-28*d*, respectively.

A vane rotor 28 includes a boss 28*e* and the vanes 28*a*-28*d*. The vanes 28*a*-28*d* are arranged one after another at generally equal intervals in the rotational direction along an outer peripheral surface of the boss 28*e*. The vanes 28*a*-28*d* are rotatably received in the receiving chambers 60, respectively. Each vane 28*a*-28*d* divides the corresponding receiving chamber 60 into a retarding chamber and an advancing chamber (hydraulic pressure chambers). Arrows, which indicate the retarding direction and the advancing direction, respectively, show the retarding direction and the advancing direction of the vane rotor 28 relative to the housing 20. As shown in FIG. 2, the vane rotor (serving as a driven-side rotator) 28 contacts an axial end surface 6*a* of the camshaft 6 and is integrally connected to the camshaft 6 along with a bush 34 by a bolt 30. An undepicted positioning pin is fitted into a fitting hole of the camshaft 6 and a fitting hole of the boss 28*e*, so that a position of the vane rotor 28 relative to the camshaft 6 in the rotational direction is fixed.

The vane rotor 28 is rotatably received in the housing 20. The axial inner side walls of the housing 20 are opposed to and are slidably engaged with the axial outer side walls of the vane rotor 28. Also, an inner peripheral wall of the peripheral wall 25 is radially opposed to and is slidably engaged with an outer peripheral wail of the vane rotor 28.

As shown in FIG. 3, seal members 36 are placed in slide gaps between the peripheral wall 25 and the vane rotor 28, which are radially opposed to each other. The seal members 36 are respectively fitted into recesses, which are provided in the vanes 28*a*-28*d* and the boss 28*e*. Furthermore, the seal members 36 are respectively urged by leaf springs 38 (FIG. 2) against the inner peripheral surface of the peripheral wall 25, which include the shoes 24*a*-24*d*. The small slide gaps are formed between the outer peripheral wall of the vane rotor 28 and the inner peripheral wall of the peripheral wall 25. The seal members 36 limit leakage of the hydraulic oil between the hydraulic pressure chambers through the small slide gaps.

Figure 2:
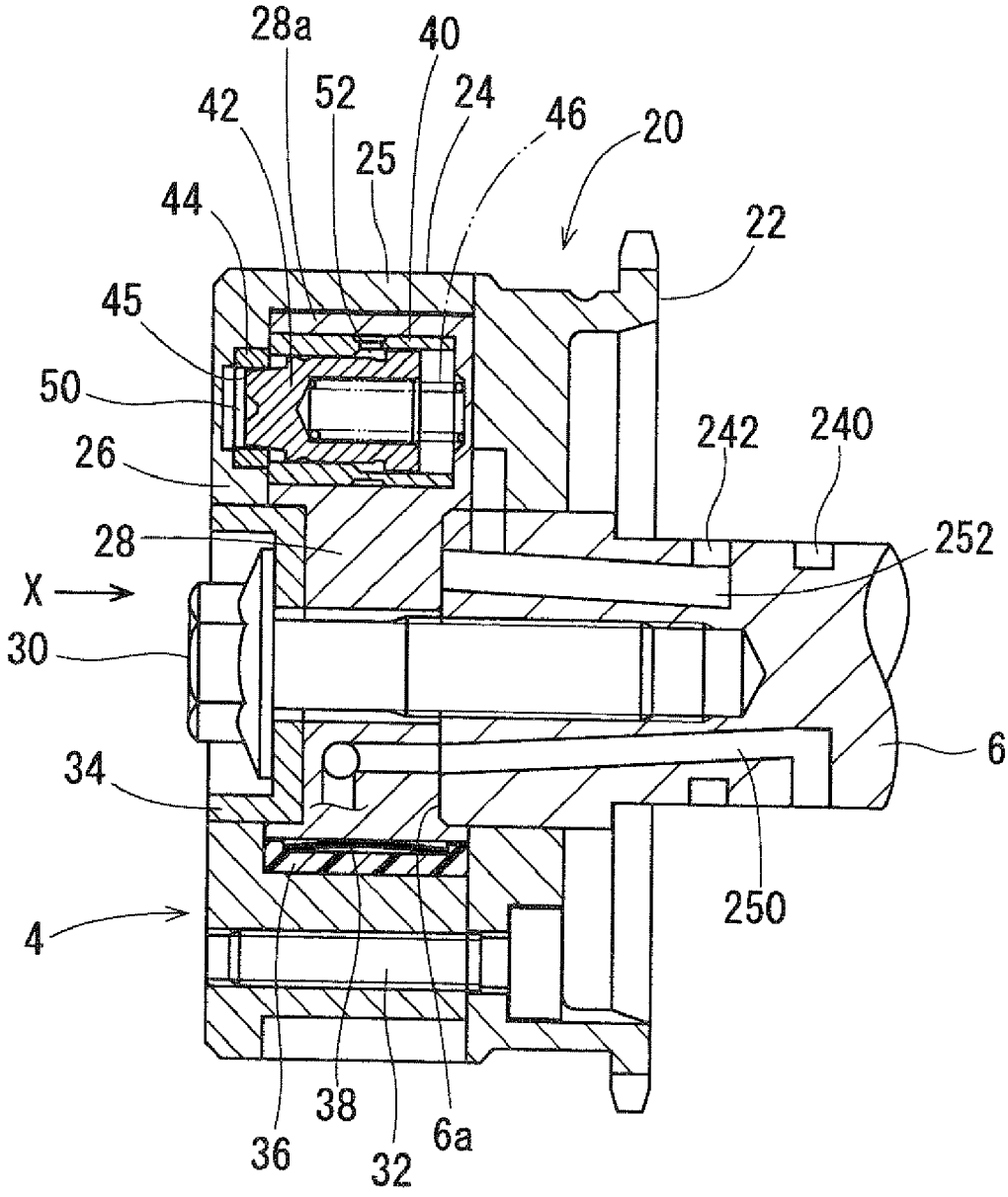
FIG. 2 is a longitudinal cross sectional view showing a valve timing mechanism of the first embodiment.

As shown in FIG. 2, a cylindrical guide ring 40 is press fitted into a corresponding hole of the vane 28*a*. A stopper piston (serving as a cylindrical engaging member) 42 is axially reciprocably received in the guide ring 40. An engaging ring 44, which forms an engaging hole 45, is press fitted into a recess, which is formed in the front plate 26. The stopper piston 42 and the engaging ring 44 are tapered toward each other, so that the stopper piston 42 can be smoothly engaged into the engaging ring 44. A spring 46 applies a load against the stopper piston 42 toward the engaging ring 44.

The pressure of the hydraulic oil, which is supplied to a hydraulic pressure chamber 50 and a hydraulic pressure chamber 52, acts in a direction for removing the stopper piston 42 from the engaging ring 44. The hydraulic pressure chamber 50 is communicated with the advancing chamber 65 (FIG. 3), and the hydraulic pressure chamber 52 is communicated with the retarding chamber 61 (FIG. 3). The stopper piston 42 is engageable with the engaging ring 44 when the vane rotor 28 is placed into a most retarded position relative to the housing 20. In the engaged state of the stopper piston 42 into the engaging ring 44, the relative rotation of the vane rotor 28 relative to the housing 20 is limited.

When the vane rotor 28 is rotated from the most retarded position toward the advancing side, the stopper piston 42 and the engaging ring 44 are displaced from each other in the rotational direction, so that the stopper piston 42 cannot be engaged into the engaging ring 44.

As shown in FIG. 3, the retarding chamber 61 is formed between the shoe 24*a* and the vane 28*a*, and the retarding chamber 62 is formed between the shoe 24*b* and the vane 28*b*. Furthermore, the retarding chamber 63 is formed between the shoe 24*c* and the vane 28*c*, and the retarding chamber 64 is formed between the shoe 24*d* and the vane 28*d*. Also, the advancing chamber 65 is formed between the shoe 24*d* and the vane 28*a*, and the advancing chamber 66 is formed between the shoe 24*a* and the vane 28*b*. In addition, the advancing chamber 67 is formed between the shoe 24*b* and the vane 28*c*, and the advancing chamber 68 is formed between the shoe 24*c* and the vane 28*d*.

As shown in FIG. 2, an annular retarding oil groove passage 240 and an annular advancing oil groove passage 242 are formed in an outer peripheral wall of the camshaft 6. The retarding oil groove passage 240 is communicated with the retarding oil passage 210, and the advancing oil groove passage 242 is communicated with the advancing oil passage 212. Furthermore, a retarding oil passage 250, which is communicated with the retarding oil groove passage 240, and an advancing oil passage 252, which is communicated with the advancing oil groove passage 242, are formed in the interior of the camshaft 6 to extend toward the axial end surface 6*a* of the camshaft 6 where the boss 28*e* of the vane rotor 28 is present. For the sake of simplicity, FIGS. 2 and 3 do not show oil passages, which supply the hydraulic oil from the retarding oil passage 250 and the advancing oil passage 252 to the respective corresponding hydraulic pressure chambers of the valve timing mechanism 4.

Now, an operation of the valve timing control system 2 will be described. The ECU 70 performs a process of a flowchart of FIG. 6 based on the oil temperature at the time of starting the engine.

In the stop state of the engine, which is before the starting of the engine, the stopper piston 42 is engaged into the engaging ring 44. In a state right after the starting of the engine, the hydraulic oil is not yet supplied from an oil pump 10 to the retarding chambers 61-64, the advancing chambers 65-68 and the hydraulic pressure chambers 50, 52. Thus, the stopper piston 42 is still engaged into the engaging ring 44, and the camshaft 6 is held in the most retarded position relative to the crankshaft. Therefore, the vane rotor 28 is repeatedly circumferentially swung back and forth to repeatedly hit the housing 20, resulting in generation of hammering sound due to the torque fluctuations received by the camshaft until the hydraulic oil is supplied to the respective corresponding hydraulic chambers.

Figure 4:
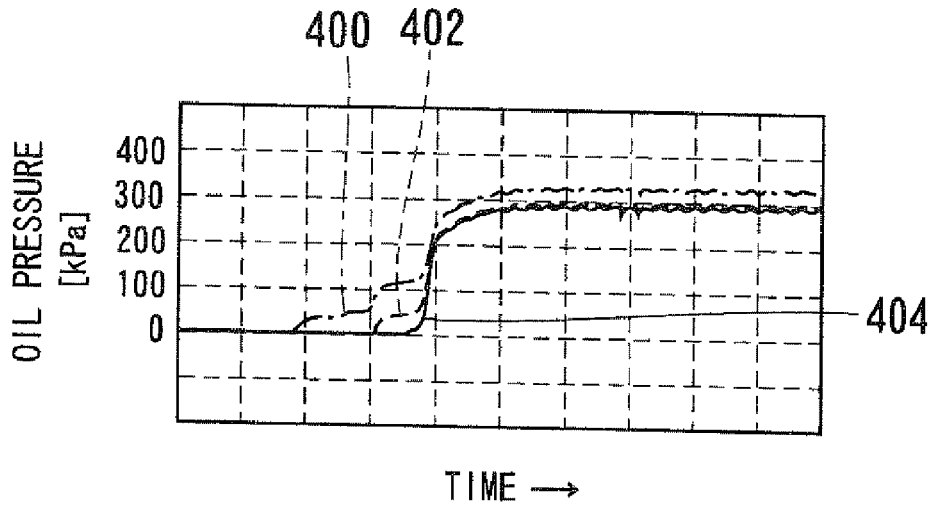
FIG. 4 is a diagram showing a change of an oil pressure in several locations after starting of an internal combustion engine.

At the time of starting the engine, a time-lag exists until the time of increasing the hydraulic pressure of the respective corresponding hydraulic pressure chambers of the valve timing mechanism 4 to a predetermined pressure upon supplying of the hydraulic oil from the oil pump 10 to the respective corresponding hydraulic pressure chambers of the valve timing mechanism 4 through the oil supply passage 200, the oil control valve 8, the retarding oil passage 210 and the advancing oil passage 212. In FIG. 4, a dot-dash line 400 indicates a hydraulic pressure increase in the oil supply passage 200 with time upon starting of the engine, and a dotted line 402 indicates a hydraulic pressure increase in the oil control valve 8. Furthermore, a solid line 404 indicates a hydraulic pressure increase in the valve timing mechanism 4. The hydraulic pressure increases (oil pressure increases) shown in FIG. 4 are measured under the conditions of the 30 degrees Celsius of the oil temperature and the 300 kPa of the discharge pressure from the oil pump 10.

Figure 5:
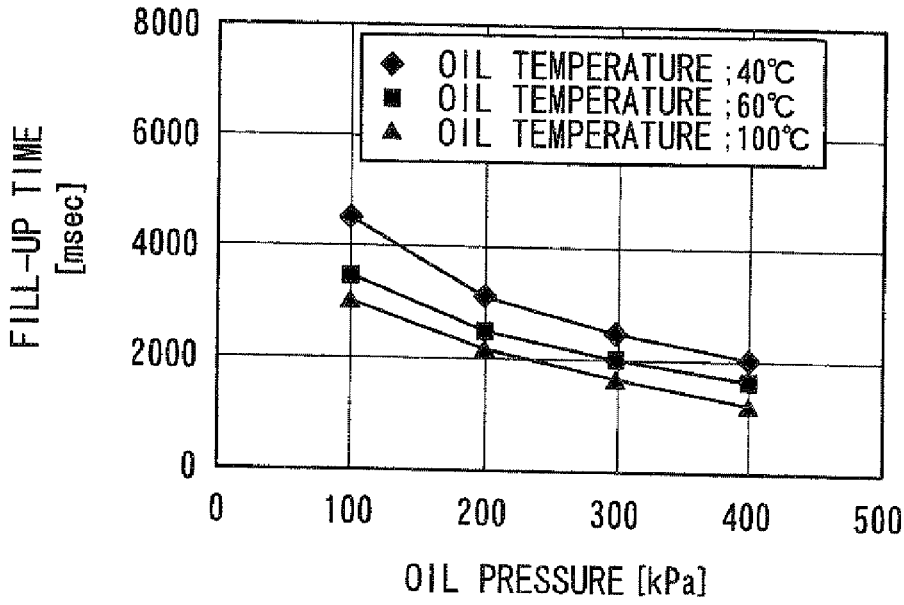
FIG. 5 is a diagram showing a relationship of an oil temperature and an oil pressure relative to a fill-up time.

Here, when the oil temperature is decreased to cause an increase in the viscosity of the hydraulic oil, the time, which is required to fill the respective corresponding hydraulic pressure chambers of the valve timing mechanism 4 with the hydraulic oil upon starting of the engine, is lengthened, as shown in FIG. 5. The stopper piston 42 cannot be removed from the engaging ring 44 until the respective corresponding hydraulic pressure chambers of the valve timing mechanism 4 are filled with the hydraulic oil. Therefore, the vane rotor 28 cannot be rotated relative to the housing 20 by the hydraulic pressure. The valve timing of each intake valve is fixed to the most retarded position and thereby cannot be controlled until the stopper piston 42 is removed from the engaging ring 44. Therefore, the noxious components of the exhaust gas cannot be reduced.

Figure 6:
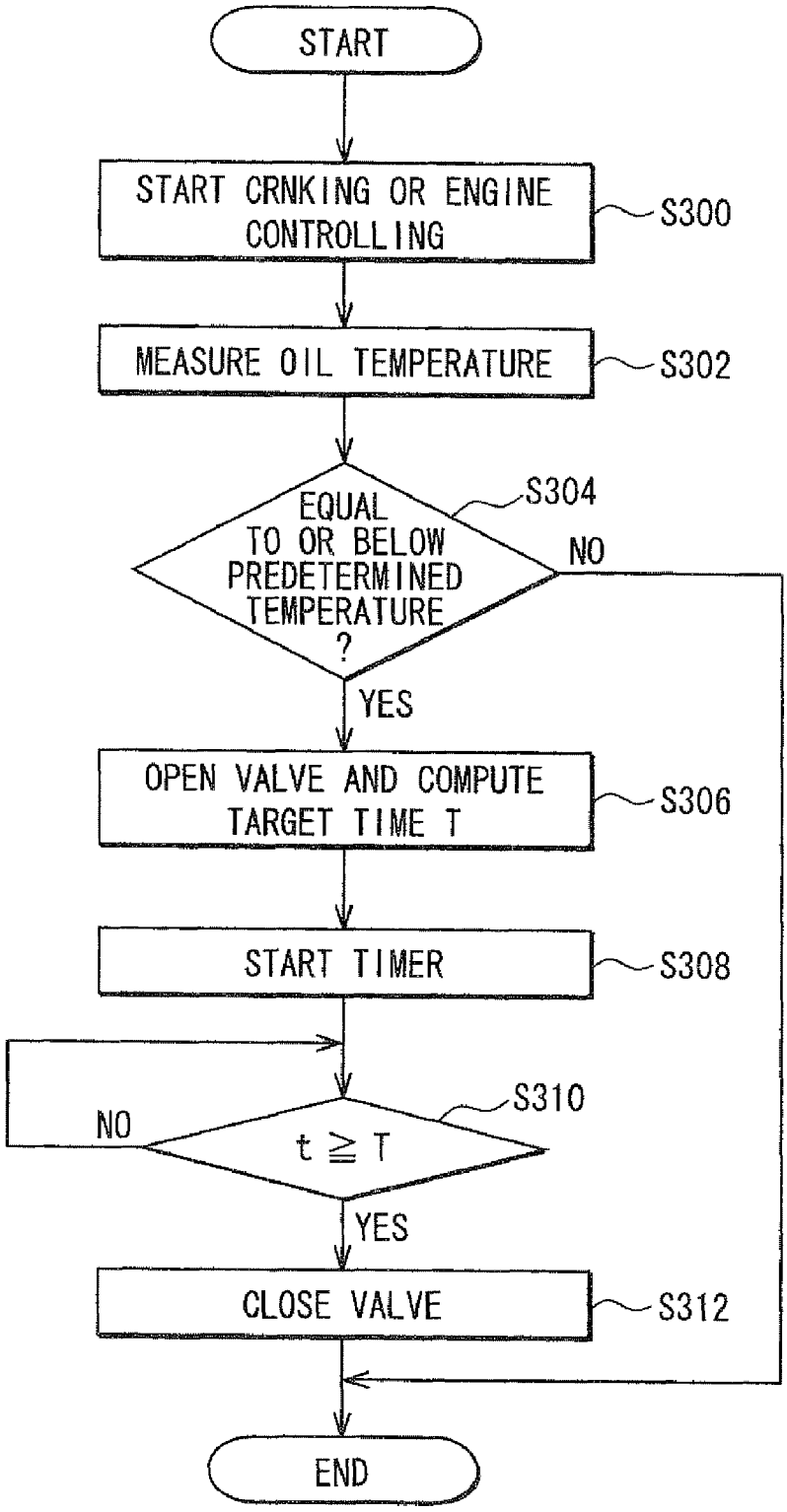
FIG. 6 is a flowchart showing an oil passage control operation at the time of starting the engine.

Thus, in the present embodiment, when cranking or engine controlling is started upon turning on of an ignition key at step S300 in FIG. 6, the ECU 70 measure the oil temperature based on the measurement signal of the oil temperature sensor 13 at step S302.

Then, at step S304, the ECU 70 determines whether the oil temperature is equal to or below a predetermined temperature. When NO is returned at step S304, the ECU 70 terminates the routine of FIG. 6. In this state, the electric power supply to the solenoid valves 14, 16 is turned off, so that the solenoid valves 14, 16 are in its valve closed state, and thereby the bypass oil passage 220 and the connection oil passage 230 are both closed. As a result, the hydraulic oil is supplied from the retarding oil passage 210 and the advancing oil passage 212 to the valve timing mechanism 4 through the oil control valve 8.

Returning to step S304, when it is determined that the oil temperature is equal to or below the predetermined temperature, the ECU 70 proceeds to step S306. At step S306, the ECU 70 turns on the electric power supply to the solenoid valves 14, 16 to open them, so that the bypass oil passage 220 and the connection oil passage 230 are opened. Then, a target time T is set based on the oil temperature.

At step S308, the ECU 70 starts a timer and measure elapsed time t with the timer. The bypass oil passage 220 and the connection oil passage 230 are opened until the elapsed time t measured with the timer reaches the target time T at step S310. Therefore, the hydraulic oil is supplied from the oil supply passage 200 to the respective corresponding hydraulic pressure chambers of the valve timing mechanism 4 through the bypass oil passage 220, the retarding oil passage 210, the connection oil passage 230 and the advancing oil passage 212. As described above, in the low temperature time period, during which the viscosity of the hydraulic oil is relatively high, the hydraulic oil is supplied to the valve timing mechanism 4 without passing through the narrow opening of the oil control valve 8. According to the present embodiment, the hydraulic oil is quickly supplied to the respective corresponding hydraulic oil pressure chambers of the valve timing mechanism 4 to fill the hydraulic pressure chambers with the hydraulic oil. In this way, the stopper piston 42 is quickly removed from the engaging ring 44 to enable the rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

When the elapsed time t measured with the timer becomes equal to or longer than the target time T at step S310, the ECU 70 turns off the electric power supply to the solenoid valves 14, 16 to close the solenoid valves 14, 16 at step S312. Thus, the bypass oil passage 220 and the connection oil passage 230 are closed, and the routine of FIG. 6 is terminated. Thereafter, the ECU 70 executes a duty ratio control operation of the oil control valve 8 to control the supplying of the hydraulic oil to the respective corresponding hydraulic pressure chambers of the valve timing mechanism 4 through the oil control valve 8 and also the draining of the hydraulic oil from the respective corresponding hydraulic pressure chambers of the valve timing mechanism 4 through the oil control valve 8.

Second Embodiment

Figure 7:
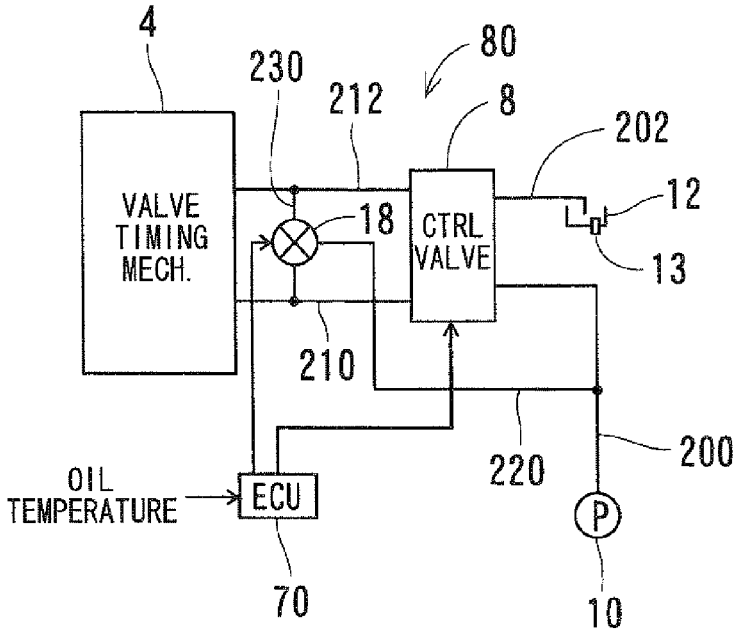
FIG. 7 is a schematic view of a valve timing control system according to a second embodiment of the present invention.

FIG. 7 shows a valve timing control system according to a second embodiment of the present invention. In this embodiment, components similar to those of the first embodiment are indicated by the same reference numerals.

In the valve timing control system 80 of the second embodiment, a three-way solenoid valve 18 is provided as a switch valve (a communication control valve) in the connection oil passage 230. The bypass oil passage 220 connects between the oil supply passage 200 and the three-way solenoid valve 18. When the electric power supply to the three-way solenoid valve 18 is turned off, the three-way solenoid valve 18 closes the connection oil passage 230 and disconnects the communication between the connection oil passage 230 bypass oil passage 220. When the electric power supply to the three-way valve 18 is turned on, the three-way solenoid valve 18 opens the connection oil passage 230 and communicates between the connection oil passage 230 and the bypass oil passage 220. The operational position of the three-way valve 18 upon the turning on of the power supply thereto is referred to as a first operational position of the three-way valve 18. Furthermore, the operational position of the three-way valve 18 upon the turning off of the power supply thereto is referred to as a second operational position of the three-way valve 18.

In the second embodiment, the ECU 70 turns on the electric power supply to the three-way solenoid valve 18 at step S306 in FIG. 6 (discussed in the first embodiment) and turns off the electric power supply to the three-way solenoid valve 18 at step S312 in FIG. 6. In this way, the connection oil passage 230 is opened to communicate between the connection oil passage 230 and the bypass oil passage 220 until the elapsed time t measured with the timer reaches the target time T, so that the hydraulic oil is supplied from the oil supply passage 200 to the respective corresponding hydraulic pressure chambers of the valve timing mechanism 4 through the bypass oil passage 220, the connection oil passage 230, the retarding oil passage 210 and the advancing oil passage 212 without passing through the oil control valve 8. As described above, in the low temperature time period, during which the viscosity of the hydraulic oil is relatively high, the hydraulic oil is supplied to the valve timing mechanism 4 without passing through the narrow opening of the oil control valve 8. Therefore, the hydraulic oil is quickly supplied to the respective corresponding hydraulic pressure chambers of the valve timing mechanism 4 to fill the hydraulic pressure chambers with the hydraulic oil. In this way, the stopper piston 42 is quickly removed from the engaging ring 44 to enable the rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

Third Embodiment

Figure 8:
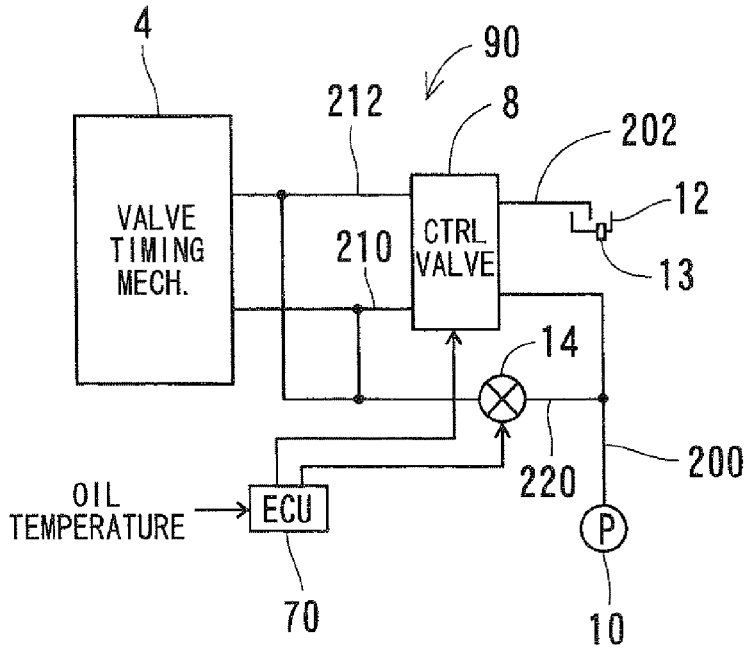
FIG. 8 is a schematic view of a valve timing control system according to a third embodiment of the present invention.

FIG. 8 shows a valve timing control system according to a third embodiment of the present invention. Here, components similar to those of the above embodiments will indicated by the same reference numerals.

In the valve timing control system 90 of the third embodiment, the solenoid valve 14 is provided in the bypass oil passage 220, and the bypass oil passage 220 is branched on the downstream side of the solenoid valve 14 and is thereby connected to the retarding oil passage 210 and the advancing oil passage 212, respectively.

In the third embodiment, the ECU 70 turns on the electric power supply to the solenoid valve 14 at step S306 in FIG. 6 and turns off the electric power supply to the solenoid valve 14 at step S312 in FIG. 6. In this way, the bypass oil passage 220 is opened until the elapsed time t measured with the timer reaches the target time T, so that the oil supply passage 200 is communicated with the retarding oil passage 210 and the advancing oil passage 212, and thereby the hydraulic oil is supplied to the respective corresponding hydraulic pressure chambers of the valve timing mechanism 4 while bypassing the oil control valve 8. As described above, in the low temperature time period, during which the viscosity of the hydraulic oil is relatively high, the hydraulic oil is supplied to the valve timing mechanism 4 without passing through the narrow opening of the oil control valve 8. Therefore, the hydraulic oil is quickly supplied to the respective corresponding hydraulic pressure chambers of the valve timing mechanism 4 to fill the hydraulic pressure chambers with the hydraulic oil. In this way, the stopper piston 42 is quickly removed from the engaging ring 44 to enable the rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

Fourth Embodiment

Figure 9:
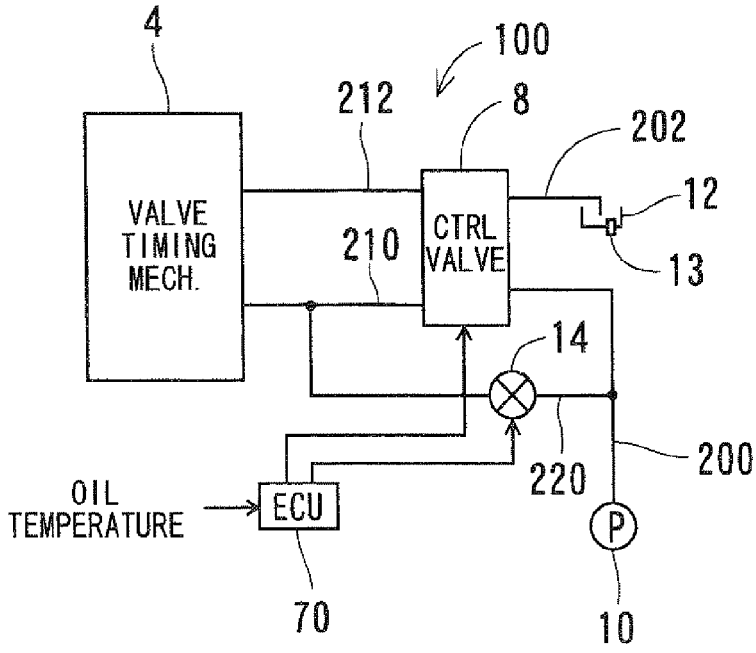
FIG. 9 is a schematic view of a valve timing control system according to a fourth embodiment of the present invention.

FIG. 9 shows a valve timing control system according to a fourth embodiment of the present invention. Here, components similar to those of the above embodiments will indicated by the same reference numerals.

In the valve timing control system 100 of the fourth embodiment, the bypass oil passage 220 connects only between the oil supply passage 200 and the retarding oil passage 210, and the solenoid valve 14 is provided in the bypass oil passage 220.

In the fourth embodiment, the ECU 70 turns on the electric power supply to the solenoid valve 14 at step S306 in FIG. 6 and turns off the electric power supply to the solenoid valve 14 at step S312 in FIG. 6. In this way, the bypass oil passage 220 is opened until the elapsed time t measured with the timer reaches the target time T, so that the oil supply passage 200 is communicated with the retarding oil passage 210, and thereby the hydraulic oil is supplied to the respective corresponding hydraulic pressure chambers of the valve timing mechanism 4 while bypassing the oil control valve 8. As described above, in the low temperature time period, during which the viscosity of the hydraulic oil is relatively high, the hydraulic oil is supplied to the retarding chambers of the valve timing mechanism 4 without passing through the narrow opening of the oil control valve 8. Therefore, the hydraulic oil is quickly supplied to the respective retarding chambers of the valve timing mechanism 4 to fill the respective retarding chambers with the hydraulic oil. In this way, the stopper piston 42 is quickly removed from the engaging ring 44 to enable the rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

Fifth Embodiment

Figure 10:
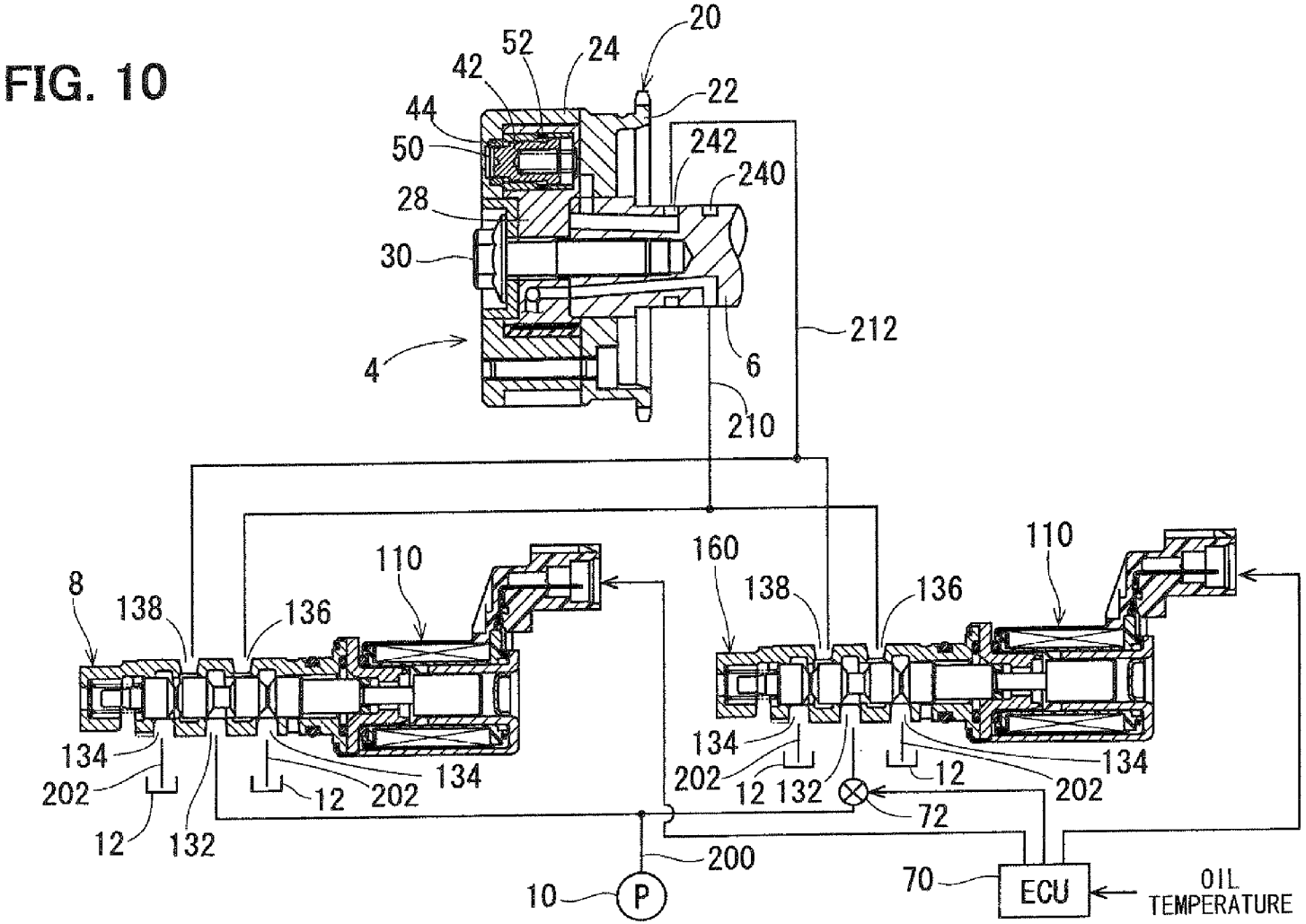
FIG. 10 is a schematic view of a valve timing control system according to a fifth embodiment of the present invention.

FIG. 10 shows a valve timing control system according to a fifth embodiment of the present invention. Here, components similar to those of the above embodiments will indicated by the same reference numerals.

In the fifth embodiment, the oil supply passage 200 and the oil drain passage 202 are connected to the retarding oil passage 210 and the advancing oil passage 212 through the oil control valve 8 and another oil control valve 160, which serve as fluid control valves and are connected in parallel. A solenoid valve 72 is a supply opening and closing valve, which is provided in the oil supply passage 200 that supplies the hydraulic oil from the oil pump 10 to the oil control valve 160. When the solenoid valve 72 is closed, the supply of the hydraulic oil from the oil pump 10 to the oil control valve 160 is stopped. In the fifth embodiment, the ECU 70 also functions as a supply control means for controlling opening and closing of the solenoid valve 72.

Figure 11A:
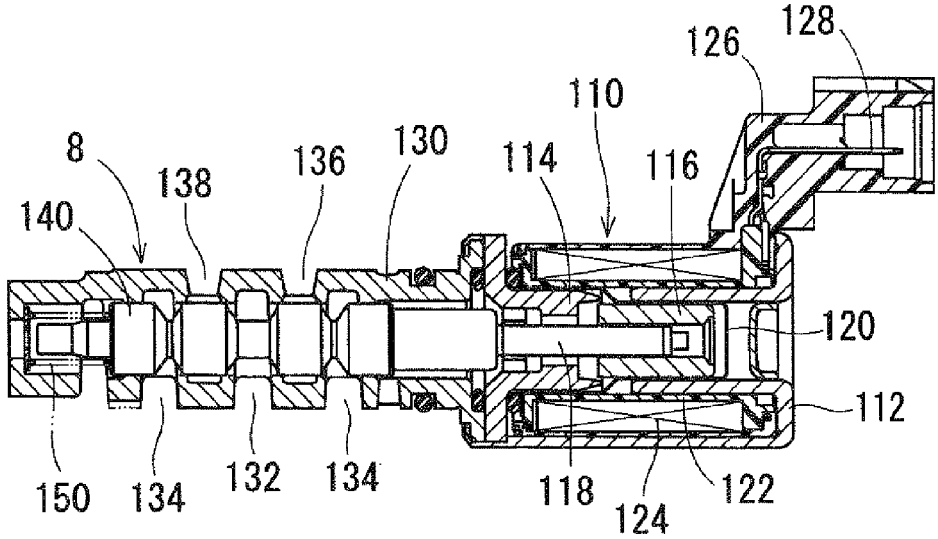
FIG. 11A is a cross sectional view showing an oil control valve of the fifth embodiment.
Figure 11B:
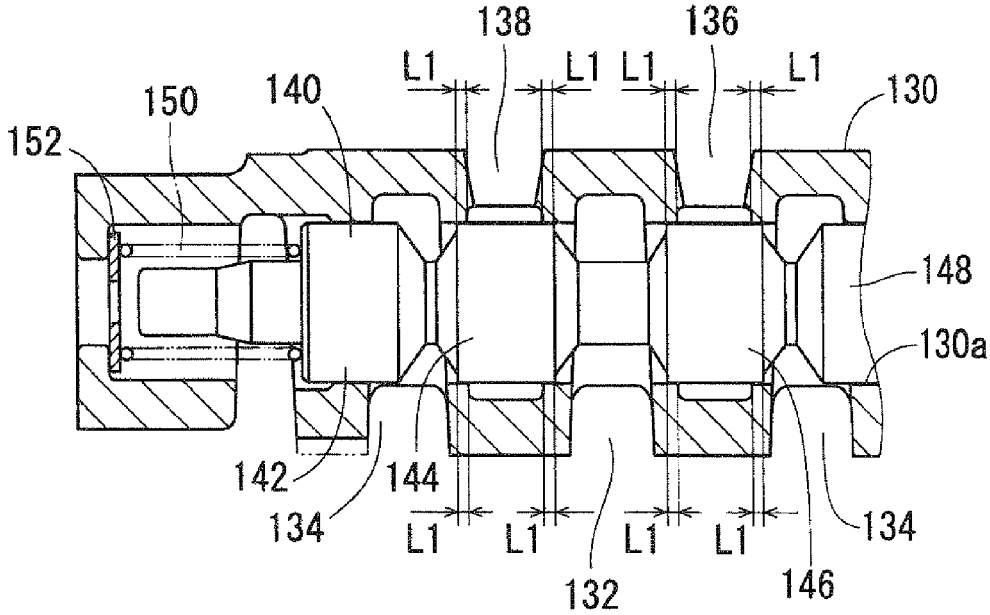
FIG. 11B is an enlarged cross sectional view showing a spool and sleeve of the oil control valve shown in FIG. 11A.

The oil control valve 8 shown in FIGS. 10 to 11B is indicated in greater detail to show detailed structure of the oil control valve 8 shown in FIGS. 1 and 7-9. As shown in FIGS. 11A and 11B, the oil control valve 8 includes a solenoid driving arrangement 110, a cylindrical sleeve 130 and a spool 140. When the electric current is supplied to the solenoid driving arrangement 110, the solenoid driving arrangement 110 generates a magnetic attractive force. The spool 140 is reciprocably received in the sleeve 130 and is reciprocably driven by the solenoid driving arrangement 110. A yoke 112 of the solenoid driving arrangement 110 is fixed by bending claws of a stator core 114 against the sleeve 130. The yoke 112 has an inner tubular portion and an outer tubular portion to implement a double structure. The oil control valve 8, the solenoid driving arrangement 110, the sleeve 130 and the spool 140 serve as a first fluid control valve, a first solenoid driving arrangement, a first housing and a first valve member respectively, of the present invention.

A movable core 116 is reciprocably received in the inner tubular portion of the yoke 112. A rod 118 is press fitted into an interior of the movable core 116 and is engaged with an axial end surface of the spool 140. A cup 120 is made of a non-magnetic material and has a peripheral wall and a bottom wall. The cup 120 covers an outer peripheral surface of the stator core 114 and also covers an outer peripheral surface of the movable core 116 at a radially inner side of the yoke 112. The bottom wall of the cup 120 covers an end portion of the movable core 116, which is opposite from the stator core 114.

A bobbin 122 is placed to surround the inner tubular portion of the yoke 112 and the outer peripheral surface of the stator core 114. A coil 124 is wound around an outer peripheral surface of the bobbin 122 and receives the electric current from terminals 128 of a connector 126.

The sleeve 130, which receives the spool 140, has a plurality of ports (openings) that extend through a tubular peripheral wall of the sleeve 130. Among these ports, an inlet port 132 is connected to the oil supply passage 200, and a drain port 134 is connected to the oil drain passage 202. Furthermore, a retarding port 136 is connected to the retarding oil passage 210, and an advancing port 138 is connected to the advancing oil passage 212.

The spool 140 is reciprocated along an inner peripheral wall 130*a* of the spool 130 while slidably engaged with the inner peripheral wall 130*a* of the sleeve 130. The spool 140 is axially slidably supported by the inner peripheral wall 130*a* of the sleeve 130. The spool 140 includes large diameter portions (lands) 142, 144, 146, 148 and small diameter portions. An outer diameter of each large diameter portion 142, 144, 146, 148 is generally the same as an inner diameter of the sleeve 130. Each small diameter portion has an outer diameter smaller than that of the large diameter portions 142, 144, 146, 148 and interconnects between corresponding adjacent two large diameter portions 142, 144, 146, 148. An end surface of the spool 140 at the solenoid driving arrangement 110 side thereof contacts an end surface of the rod 118.

One end of a spring 150 is engaged with an end portion of the spool 140 at the side opposite from the rod 118, and the other end of the spring 150 is engaged with a plate 152. The spring 150 applies a load against the spool 140 toward the rod 118.

Figure 12A:
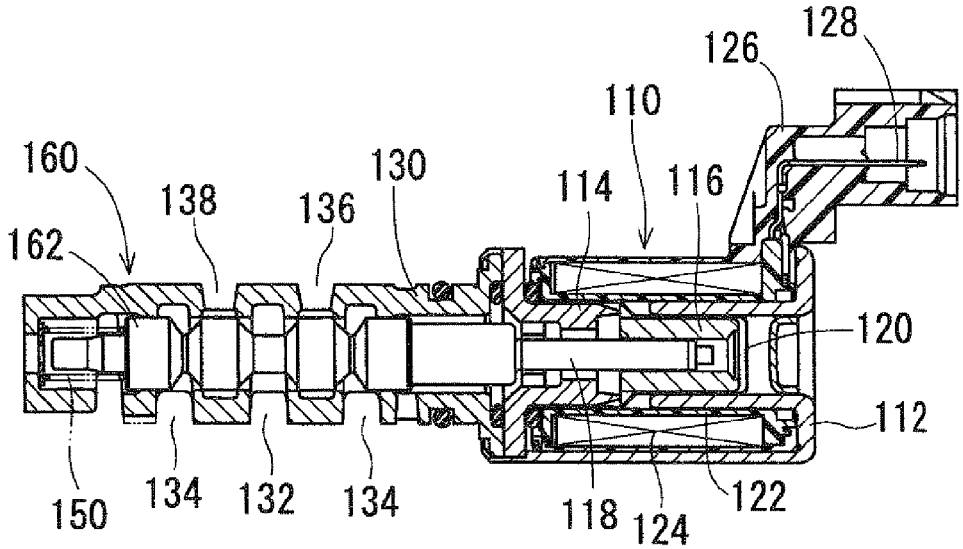
FIG. 12A is a cross sectional view showing another oil control valve of the fifth embodiment.
Figure 12B:
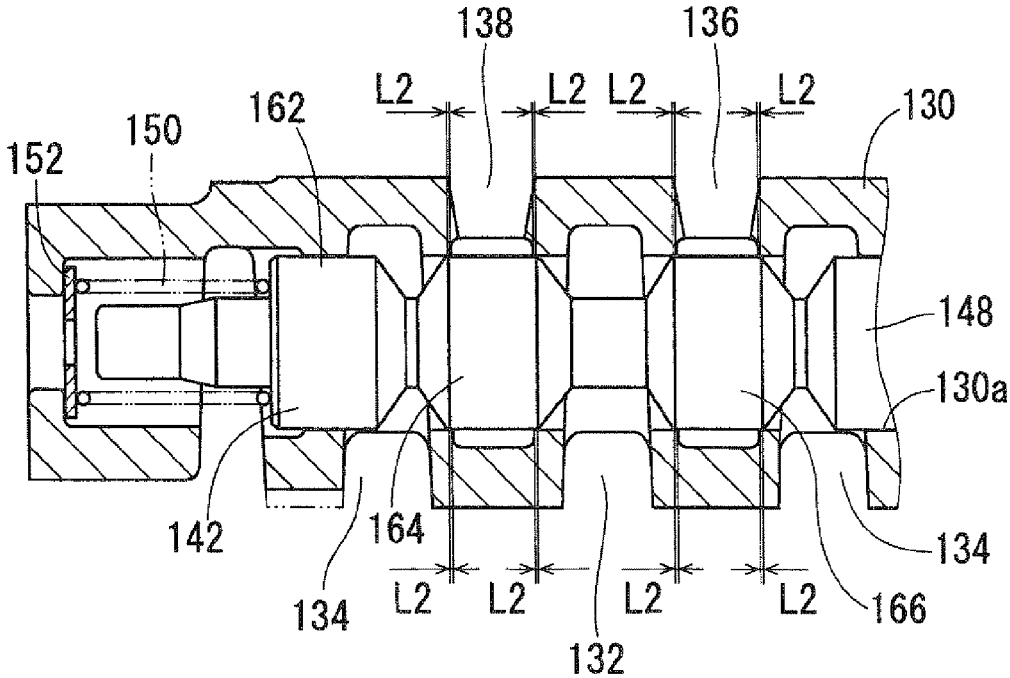
FIG. 12B is an enlarged cross sectional view showing a spool and sleeve of the oil control valve shown in FIG. 12A.

The basic structure of the oil control valve 160 shown in FIG. 12 is the same as that of the oil control valve 8. However, the axial lengths of the large diameter portions 164, 166, which are formed in the spool 162 of the oil control valve 160, are shorter than the axial lengths of the corresponding large diameter portions 144, 146 of the spool 140 of the oil control valve 8. Therefore, in the intermediate holding position shown in FIGS. 11A to 12B for disconnecting both of the oil supply passage 200 and the oil drain passage 202 from the retarding oil passage 210 and the advancing oil passage 212, a seal length L2 between each of the large diameter portions 164/166 of the oil control valve 160 and the inner peripheral wall 130*a* of the sleeve 130 is shorter than a seal length L1 between each of the large diameter portions 144, 146 of the oil control valve 8 and the inner peripheral wall 130*a* of the sleeve 130. In the present embodiment, the seal lengths L1, L2 are set as: 0.4 mm≦L1≦0.5 mm and 0.0 mm≦L2≦0.25 mm. The oil control valve 160, the solenoid driving arrangement 110 of the oil control valve 160, the sleeve 130 of the oil control valve 160 and the spool 162 of the oil control valve 160 serve as a second fluid control valve, a second solenoid driving arrangement, a second housing and a second valve member, respectively, of the present invention. Although the seal length of the oil control valve 160 is shorter than the seal length of the oil control valve 8, an amount of leakage of the hydraulic oil from the sealing portion between the sleeve 130 and the sleeve 160 is relatively small in the intermediate holding position shown in FIGS. 12A and 12B. Thus, the vane rotor 28 can be held in the intermediate position relative to the housing 20.

When the power supply to the coil 124 is turned off at 0% of the duty ratio, the spool 140, 162 of each of the oil control valves 8, 160 is urged into the solenoid driving arrangement 110 side by the load of the spring 150. In this state, each of the oil control valves 8, 160 communicates between the oil supply passage 200 and the retarding oil passage 210 and also communicates between the oil drain passage 202 and the advancing oil passage 212. When the duty ratio is increased from 0%, the movable core 116 is attracted to the stator core 114 side against the load of the spring 150 and is thereby moved beyond the intermediate holding position shown in FIGS. 11A to 12B, so that the oil drain passage 202 is communicated with the retarding oil passage 210, and the oil supply passage 200 is communicated with the advancing oil passage 212.

Figure 13:
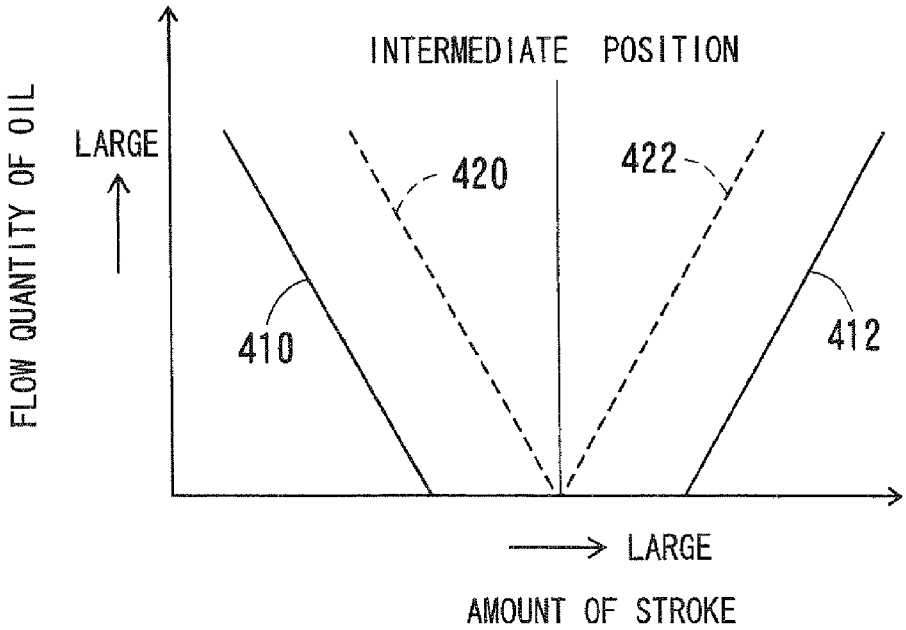
FIG. 13 is a diagram showing a relationship between an amount of stroke of a spool and a flow quantity of hydraulic oil.

FIG. 13 shows a relationship between an amount of stroke of the spool 140 and a flow quantity of the hydraulic oil supplied from the oil control valve 8, 160 to the retarding oil passage 210 and the advancing oil passage 212. In FIG. 13, when the duty ratio is increased from 0%, the amount of stroke is increased. A solid line 410 indicates the flow quantity of the hydraulic oil supplied from the oil control valve 8 to the retarding oil passage 210, and a solid line 412 indicates the flow quantity of the hydraulic oil from the oil control valve 8 to the advancing oil passage 212. Furthermore, a dotted line 420 indicates the flow quantity of the hydraulic oil from the oil control valve 160 to the retarding oil passage 210, and a dotted line 422 indicates the flow quantity of the hydraulic oil from the oil control valve 160 to the advancing oil passage 212.

Figure 14A:
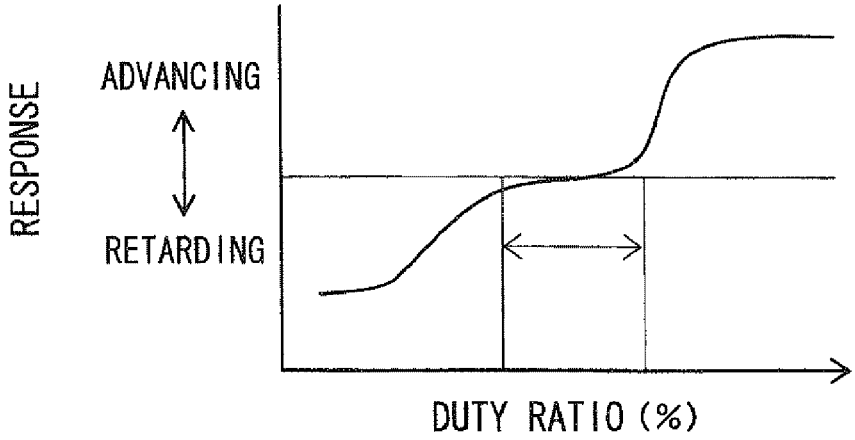
FIG. 14A is a diagram showing a relationship between a duty ratio and a response of the oil control valve shown in FIGS. 12A and 12B.
Figure 14B:
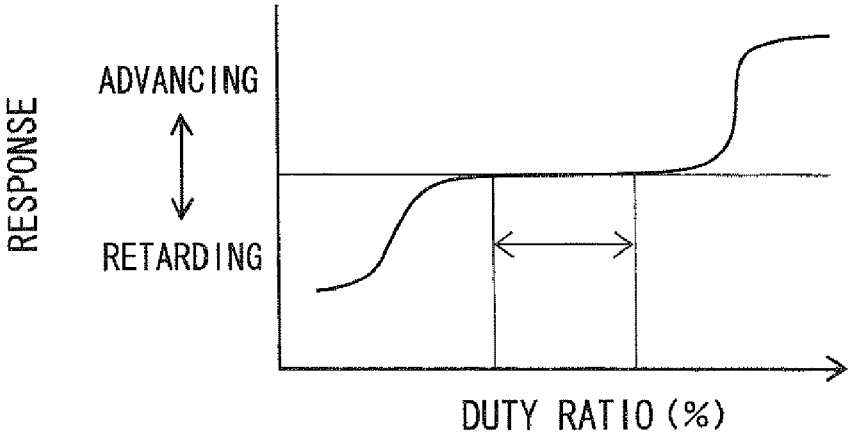
FIG. 14B is a diagram showing a relationship between a duty ratio and a response of the oil control valve shown in FIGS. 11A and 11B.

As clearly understandable from FIG. 13, when the spool 162 under the duty ratio control is moved from the intermediate position (the position for disconnecting the oil supply passage 200 and the oil drain passage 202 from the retarding oil passage 210 and the advancing oil passage 212) toward the retarding side or the advancing side, the hydraulic oil is quickly supplied to the retarding oil passage 210 or the advancing oil passage 212. In other words, around the intermediate position, in comparison to the response of the oil control valve 8 shown in FIG. 14B, the oil control valve 160 shows the improved response in the phase control toward the retarding side or the advancing side upon making the small duty ratio adjustment, as shown in FIG. 14A. Furthermore, when the same amount of stroke is made, the flow quantity of the hydraulic oil, which is supplied from the oil control valve 160, becomes larger than the flow quantity of the hydraulic oil, which is supplied from the oil control valve 8.

This is due to the following reason. That is, in the oil control valve 160, the seal length between the spool 162 and the inner peripheral wall 130*a* of the sleeve 130 is shortened in comparison to that of the oil control valve 8. Thus, when the same amount of stroke is made, the opening area of each corresponding port of the oil control valve 160 is increased in comparison to that of the oil control valve 8.

In the fifth embodiment, under the low temperature condition where the viscosity of the hydraulic oil becomes relatively high, the ECU 70 opens the solenoid valve 72 to supply the hydraulic oil from the oil pump 10 to the oil control valve 160, so that the hydraulic oil is more quickly supplied to the respective corresponding hydraulic pressure chambers of the valve timing mechanism 4 to fill the same in comparison to the case where the hydraulic oil is supplied to the respective corresponding hydraulic pressure chambers of the valve timing mechanism 4 only from the oil control valve 8. In this way, the vane rotor 28 can rotate more quickly relative to the housing 20. Furthermore, at the time of starting the engine under the low temperature, the hydraulic oil is quickly supplied to the respective corresponding hydraulic pressure chambers of the valve timing mechanism 4 to fill the same. Thus, the stopper piston 42 can be quickly removed from the engaging ring 44 to enable the rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

When the oil temperature becomes higher than the predetermined temperature, the ECU 70 closes the solenoid valve 72 to stop the supply of the hydraulic oil from the oil pump 10 to the oil control valve 160. When the oil temperature is increased to reduce the viscosity of the hydraulic oil, the respective corresponding hydraulic pressure chambers of the valve timing mechanism 4 can be quickly filled by the oil control valve 8 alone. Furthermore, when the oil temperature is increased above the predetermined temperature, the ECU 70 changes the duty ratio to 0% to turn off the electric power supply to the oil control valve 160, so that only the oil control valve 8 is operated under the duty ratio control to execute the phase control operation. In this state, the supply of the hydraulic oil from the oil pump 10 to the oil control valve 160 is stopped, and the advancing oil passage 212, which is connected to the oil control valve 160, is connected to the oil drain passage 202 through the oil control valve 160. The ECU 70 executes the phase control through the feedback control. Thus, even when the oil temperature is increased, and thereby the advancing oil passage 212, which is connected to the oil control valve 160, is connected to the oil drain passage 202 through the oil control valve 160, the phase of the vane rotor 20 relative to the housing 20 can be set to the target phase.

Sixth Embodiment

Figure 15A:
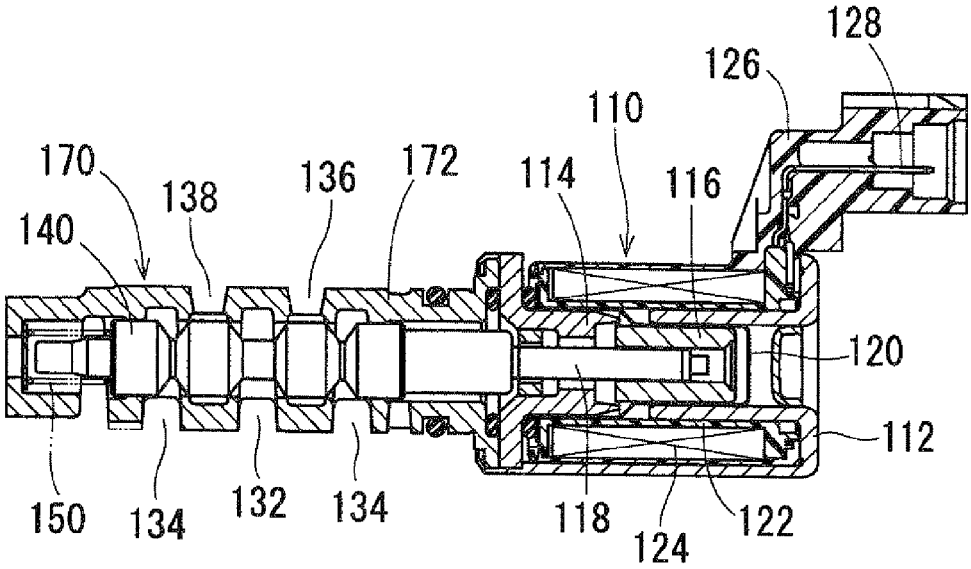
FIG. 15A is a cross sectional view showing an oil control valve of a sixth embodiment.
Figure 15B:
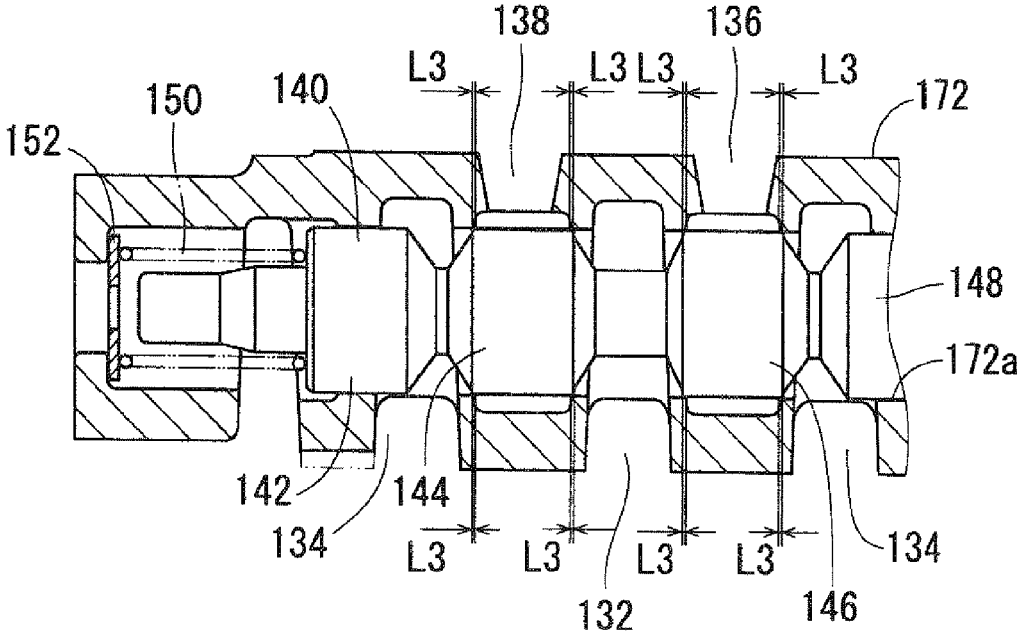
FIG. 15B is an enlarged cross sectional view showing a spool and sleeve of the oil control valve shown in FIG. 15A.

FIG. 15 shows a valve timing control system according to a sixth embodiment of the present invention. Here, components similar to those of the above embodiments will indicated by the same reference numerals.

In the sixth embodiment, an oil control valve 170 is used as the fluid control valve in place of the oil control valve 160 of the fifth embodiment. The oil control valve 170, the solenoid driving arrangement 110 of the oil control valve 170, a sleeve 172 of the oil control valve 170 and the spool 140 of the oil control valve 170 serve as a second fluid control valve, a second solenoid driving arrangement, a second housing and a second valve member, respectively, of the present invention. In the oil control valve 170, the axial length of each of the sealing portions of the inner peripheral wall 172*a* of the sleeve 172, which form the seals in corporation with the large diameter portions 144, 146, is shorter than the axial length of each of the corresponding sealing portions of the inner peripheral wall 130*a* of the sleeve 130 of the oil control valve 8, which corresponds to the inner peripheral wall 172*a* of the sleeve 172. In this way, in the intermediate holding position shown in FIGS. 15A and 15B, at which the oil supply passage 200 and the oil drain passage 202 are disconnected from the retarding oil passage 210 and the advancing oil passage 212, the seal length L3 of each of the large diameter portions 144, 146 of the oil control valve 170 relative to the inner peripheral wall 172*a* of the sleeve 172, is shorter than the seal length L1 of each of the large diameter portions 144, 146 of the oil control valve 8 relative to the inner peripheral wall 130*a* of the sleeve 130.

With the above construction, under the low temperature condition where the viscosity of the hydraulic oil is relative high, the ECU 70 opens the solenoid valve 72 to supply the hydraulic oil from the oil pump 10 to the oil control valve 170. Thus, the hydraulic oil can be more quickly supplied to the respective corresponding hydraulic pressure chambers of the valve timing mechanism 4 to fill the same in comparison to the case where the hydraulic oil is supplied to the respective corresponding hydraulic pressure chambers of the valve timing mechanism 4 only from the oil control valve 8. In this way, the vane rotor 28 can rotate more quickly relative to the housing 20. Furthermore, at the time of starting the engine under the low temperature condition, the hydraulic oil can be quickly supplied to the respective corresponding hydraulic pressure chambers of the valve timing mechanism 4 to fill the same. Thus, the stopper piston 42 is quickly removed from the engaging ring 44 to enable the relative rotation of the vane rotor 28 relative to the housing 20. As a result, it is possible to reduce the deviation of the timing for controlling the valve timing, and thereby it is possible to reduce the noxious components contained in the exhaust gas, which is exhausted from the engine after starting of the engine.

When the oil temperature becomes higher than the predetermined temperature, the ECU 70 closes the solenoid valve 72 to stop the supply of the hydraulic oil from the oil pump 10 to the oil control valve 170. When the oil temperature is increased to reduce the viscosity of the hydraulic oil, the respective corresponding hydraulic pressure chambers of the valve timing mechanism 4 can be quickly filled with the hydraulic oil by the oil control valve 8 alone.

Now, modifications of the above embodiments will be described.

In the first embodiment, when the oil temperature is equal to or less than the predetermined temperature, the target time is computed based on the oil temperature to variably set the valve open time period of the solenoid valves 14, 16. Alternatively, when the oil temperature is equal to or less than the predetermined temperature, the valve open time period may be set to a constant time period. Furthermore, in the case where the oil temperature is equal to or less than the predetermined temperature, instead of setting the valve open time period of the solenoid valves 14, 16, an oil pressure of the hydraulic pressure chamber(s) of the valve timing mechanism 4 may be sensed. The solenoid valves 14, 16 may be left opened until the oil pressure of the hydraulic pressure chamber(s) of the valve timing mechanism 4 becomes equal to or larger than a predetermined pressure. Furthermore, alternative to the use of the oil temperature sensor 13, the oil temperature of the hydraulic oil may be estimated based on a measurement signal of, for example, a water temperature sensor (or a coolant temperature sensor).

In the fourth embodiment, the bypass oil passage 220 connects only between the oil supply passage 200 and the retarding oil passage 210. Alternatively, the bypass oil passage 220 may be configured to connect only between the oil supply passage 200 and the advancing oil passage 212.

In the fifth embodiment, the solenoid valve 72 is provided in the oil supply passage 200, which is connected to the oil control valve 160. When the oil temperature is increased above the predetermined temperature, the solenoid valve 72 is closed to stop the supply of the hydraulic oil from the oil pump 10 to the oil control valve 160. Alternatively, the solenoid valve 72 may be eliminated. In such a case, both of the oil control valves 8, 160 may be operated under the duty ratio control.

In the above embodiments, the arresting mechanism, in which the stopper piston 42 is engaged into the engaging ring 44, is used to limit or arrest the rotation of the vane rotor 28 relative to the housing 20. Alternatively, in the present invention, the arresting mechanism may be eliminated from the valve timing control system.

Furthermore, in place of the chain sprocket of the above embodiments, a cam pulley or a timing gear may be used to transmit the rotational drive force of the crankshaft to the camshaft. Furthermore, the drive force of the crankshaft may be received by the vane rotor, and the camshaft and the housing may be connected together to rotate together.

In the above embodiments, the vane type valve timing mechanism is used. Alternatively, as recited in Japanese Patent No. 2998565, a helical gear having helical teeth may be used to form the valve timing mechanism.

In the above embodiments, the present invention is implemented in the valve timing control system of the intake valves. Alternatively, the present invention may be applied to a valve timing control system, which controls the exhaust valves or both of the intake valves and the exhaust valves.

As discussed above, the present invention is not limited to the above embodiments and may be modified within a scope and spirit of the present invention, and any one or more components of any one of the above embodiments and modifications may be combined with any one or more components of another one of the above embodiments and modifications. For example, in place of the oil control valve 8 of the first embodiment shown in FIG. 1, the oil control valves 8, 160 of the fifth embodiment may be provided in parallel to connect with the oil supply passage 200 and the oil drain passage 202 at one side thereof and the retarding oil passage 210 and the advancing oil passage 212 at the other side thereof.

What is claimed is:

1. A valve timing control system provided in a drive force transmission system, which transmits a drive force from a driving shaft of an internal combustion engine to a driven shaft that is driven to open and close at least one of an intake valve and an exhaust valve of the engine, the valve timing control system controlling opening and closing timing of at least one of the intake valve and the exhaust valve and comprising:

a valve timing mechanism that controls a rotational phase of the driven shaft relative to the driving shaft according to a fluid pressure of working fluid exerted in at least one retarding chamber of the valve timing mechanism and a fluid pressure of working fluid exerted in at least one advancing chamber of the valve timing mechanism;

at least one fluid control valve that is connected to a fluid supply passage and a fluid drain passage at a first side of the at least one fluid control valve and is connected to a retarding passage communicated with the at least one retarding chamber and an advancing passage communicated with the at least one advancing chamber at a second side of the at least one fluid control valve, wherein the at least one fluid control valve controls a communication state of the retarding passage and the advancing passage relative to the fluid supply passage and the fluid drain passage;

a communication control valve that enables and disables communication of a bypass passage, which extends from the fluid supply passage and bypasses the at least one fluid control valve, to at least one of the retarding passage and the advancing passage; and a bypass control means for controlling the communication control valve, wherein the bypass control means controls the communication control valve to enable the communication of the bypass passage to the at least one of the retarding passage and the advancing passage when a temperature is equal to or less than a predetermined temperature, and the bypass control means controls the communication control valve to disable the communication of the bypass passage to the at least one of the retarding passage and the advancing passage when the temperature is higher than the predetermined temperature.

2. The valve timing control system according to claim 1, wherein:

the communication control valve is a bypass opening and closing valve that is provided in the bypass passage to open and close the bypass passage;

the bypass control means controls the bypass opening and closing valve to open the bypass passage when the temperature is equal to or less than the predetermined temperature; and the bypass control means controls the bypass opening and closing valve to close the bypass passage when the temperature is higher than the predetermined temperature.

3. The valve timing control system according to claim 2, wherein when the temperature is equal to or less than the predetermined temperature at time of starting the engine, the bypass control means sets an open time period of the bypass passage by controlling the bypass opening and closing valve based on the temperature at the time of starting the engine.

4. The valve timing control system according to claim 1, further comprising a connection opening and closing valve that is provided in a connection passage, which connects between the retarding passage and the advancing passage, to open and close the connection passage, wherein:

the communication control valve is a bypass opening and closing valve that is provided in the bypass passage to open and close the bypass passage;

the bypass passage connects one of the retarding passage and the advancing passage to the fluid supply passage;

the bypass control means is also for controlling opening and closing of the connection opening and closing valve, wherein the bypass control means control the bypass opening and closing valve and the connection opening and closing valve to open the bypass passage and the connection passage when the temperature is equal to or less than the predetermined temperature, and the bypass control means controls the bypass opening and closing valve and the connection opening and closing valve to close the bypass passage and the connection passage when the temperature is higher than the predetermined temperature.

5. The valve timing control system according to claim 4, wherein when the temperature is equal to or less than the predetermined temperature at time of starting the engine, the bypass control means sets an open time period of the bypass passage and an open time period of the connection passage by controlling the bypass opening and closing valve and the connection opening and closing valve based on the temperature at the time of starting the engine.

6. The valve timing control system according to claim 1, wherein:

the communication control valve is a switch valve that is provided in a connection between the bypass passage and a connection passage, which connects between the retarding passage and the advancing passage;

the switch valve is changeable between:

a first operational position, at which the switch valve opens the connection passage and communicates between the connection passage and the bypass passage; and a second operational position, at which the switch valve closes the connection passage and disconnects communication between the connection passage and the bypass passage; and the bypass control means places the switch valve in the first operational position when a temperature is equal to or less than a predetermined temperature, and the bypass control means places the switch valve in the second operational position when the temperature is higher than the predetermined temperature.

7. The valve timing control system according to claim 6, wherein when the temperature is equal to or less than the predetermined temperature at time of starting the engine, the bypass control means sets a time period for placing the switch valve in the first operational position based on the temperature at the time of starting the engine.

8. The valve timing control system according to claim 1, wherein:

the at least one fluid control valve includes first and second fluid control valves;

the first fluid control valve includes:

a first housing that includes a plurality of openings, which are communicated with the fluid supply passage, the fluid drain passage, the retarding passage and the advancing passage, respectively;

a first valve member that is reciprocably received in the first housing to control the communication state of the retarding passage and the advancing passage relative to the fluid supply passage and the fluid drain passage according to a position of the first valve member in a reciprocating direction of the first valve member; and a first solenoid driving arrangement that drives the first valve member in the reciprocating direction of the first valve member;

the second fluid control valve includes:

a second housing that includes a plurality of openings, which are communicated with the fluid supply passage, the fluid drain passage, the retarding passage and the advancing passage, respectively;

a second valve member that is reciprocably received in the second housing to control the communication state of the retarding passage and the advancing passage relative to the fluid supply passage and the fluid drain passage according to a position of the second valve member in a reciprocating direction of the second valve member; and a second solenoid driving arrangement that drives the second valve member in the reciprocating direction of the second valve member; and a seal length between the second valve member and an inner peripheral wall of the second housing in the second fluid control valve is shorter than a seal length between the first valve member and an inner peripheral wall of the first housing in the first fluid control valve.

9. The valve timing control system according to claim 8, further comprising:

a supply opening and closing valve that opens and closes a portion of the fluid supply passage connected to the second fluid control valve; and a supply control means for controlling the supply opening and closing valve, wherein supply control means opens the supply opening and closing valve to communicate the fluid supply passage to the second fluid control valve when the temperature is equal to or less than the predetermined temperature, and the supply control means closes the supply opening and closing valve to disable the communication of the fluid supply passage to the second fluid control valve when the temperature is higher than the predetermined temperature.

10. The valve timing control system according to claim 1, wherein the valve timing mechanism includes:

a housing that is rotated integrally with one of the driving shaft and the driven shaft and includes at least one receiving chamber, each of which is formed within a predetermined angular range in a rotational direction of the housing; and a vane rotor that is rotated together with the other one of the driving shaft and the driven shaft and includes at least one vane, each of which is received in a corresponding one of the at least one receiving chamber to divide the receiving chamber into a retarding chamber and an advancing chamber, wherein the vane rotor is rotated in a retarding side or an advancing side relative to the housing according to a fluid pressure of working fluid exerted in the retarding chamber and a fluid pressure of working fluid exerted in the advancing chamber.

11. The valve timing control system according to claim 10, wherein:

one of the housing and the vane rotor includes an engaging hole;

the other one of the housing and the vane rotor includes an engaging member, which is reciprocably received in the other one of the housing and the vane rotor;

when the engaging member is engaged into the engaging hole, rotation of the vane rotor relative to the housing is limited; and the engaging member is removable from the engaging hole by a fluid pressure of working fluid supplied from at least one of the retarding passage and the advancing passage.

12. A valve timing control system provided in a drive force transmission system, which transmits a drive force from a driving shaft of an internal combustion engine to a driven shaft that is driven to open and close at least one of an intake valve and an exhaust valve of the engine, the valve timing control system controlling opening and closing timing of at least one of the intake valve and the exhaust valve and comprising:

a valve timing mechanism that controls a rotational phase of the driven shaft relative to the driving shaft according to a fluid pressure of working fluid exerted in at least one retarding chamber of the valve timing mechanism and a fluid pressure of working fluid exerted in at least one advancing chamber of the valve timing mechanism;

a first fluid control valve that is connected to a fluid supply passage and a fluid drain passage at a first side of the first fluid control valve and is connected to a retarding passage communicated with the at least one retarding chamber and an advancing passage communicated with the at least one advancing chamber at a second side of the first fluid control valve, wherein the first fluid control valve includes:

a first housing that includes a plurality of openings, which are communicated with the fluid supply passage, the fluid drain passage, the retarding passage and the advancing passage, respectively;

a first valve member that is reciprocably received in the first housing to control a communication state of the retarding passage and the advancing passage relative to the fluid supply passage and the fluid drain passage according to a position of the first valve member in a reciprocating direction of the first valve member; and a first solenoid driving arrangement that drives the first valve member in the reciprocating direction of the first valve member; and a second fluid control valve that is connected to the fluid supply passage and the fluid drain passage at a first side of the second fluid control valve and is connected to the retarding passage and the advancing passage at a second side of the second fluid control valve, wherein the second fluid control valve is placed in parallel with the first fluid control valve and includes:

a second housing that includes a plurality of openings, which are communicated with the fluid supply passage, the fluid drain passage, the retarding passage and the advancing passage, respectively;

a second valve member that is reciprocably received in the second housing to control the communication state of the retarding passage and the advancing passage relative to the fluid supply passage and the fluid drain passage according to a position of the second valve member in a reciprocating direction of the second valve member; and a second solenoid driving arrangement that drives the second valve member in the reciprocating direction of the second valve member, wherein a seal length between the second valve member and an inner peripheral wail of the second housing in the second fluid control valve is shorter than a seal length between the first valve member and an inner peripheral wall of the first housing in the first fluid control valve.

13. The valve timing control system according to claim 12, further comprising:

a supply opening and closing valve that opens and closes a portion of the fluid supply passage connected to the second fluid control valve; and a supply control means for controlling the supply opening and closing valve, wherein supply control means opens the supply opening and closing valve to communicate the fluid supply passage to the second fluid control valve when a temperature is equal to or less than a predetermined temperature, and the supply control means closes the supply opening and closing valve to disable the communication of the fluid supply passage to the second fluid control valve when the temperature is higher than the predetermined temperature.

14. The valve timing control system according to claim 12, wherein the valve timing mechanism includes:

a housing that is rotated integrally with one of the driving shaft and the driven shaft and includes at least one receiving chamber, each of which is formed within a predetermined angular range in a rotational direction of the housing; and a vane rotor that is rotated together with the other one of the driving shaft and the driven shaft and includes at least one vane, each of which is received in a corresponding one of the at least one receiving chamber to divide the receiving chamber into a retarding chamber and an advancing chamber, wherein the vane rotor is rotated in a retarding side or an advancing side relative to the housing according to a fluid pressure of working fluid exerted in the retarding chamber and a fluid pressure of working fluid exerted in the advancing chamber.

15. The valve timing control system according to claim 14, wherein:

one of the housing and the vane rotor includes an engaging hole;

the other one of the housing and the vane rotor includes an engaging member, which is reciprocably received in the other one of the housing and the vane rotor;

when the engaging member is engaged into the engaging hole, rotation of the vane rotor relative to the housing is limited; and the engaging member is removable from the engaging hole by a fluid pressure of working fluid supplied from at least one of the retarding passage and the advancing passage.

* * * * *